US008011982B1

(12) United States Patent
Baier et al.

(10) Patent No.: US 8,011,982 B1
(45) Date of Patent: Sep. 6, 2011

(54) OUTBOARD MOTOR SUPPORT SYSTEM

(75) Inventors: Mark A. Baier, Oshkosh, WI (US); Brad Van Ruiswyk, Waupun, WI (US); John D. Skroski, Oshkosh, WI (US); George D. Idzikowski, Lomira, WI (US)

(73) Assignee: Brunswick Corporation, Lake Forest, IL (US)

( * ) Notice: Subject to any disclaimer, the term of this patent is extended or adjusted under 35 U.S.C. 154(b) by 346 days.

(21) Appl. No.: 12/369,015

(22) Filed: Feb. 11, 2009

(51) Int. Cl.
*B63H 5/20* (2006.01)

(52) U.S. Cl. ..... 440/53

(58) Field of Classification Search ..... 440/49, 440/53

See application file for complete search history.

(56) References Cited

U.S. PATENT DOCUMENTS

| | | | | |
|---|---|---|---|---|
| 2,914,020 | A * | 11/1959 | Van Raden | 440/55 |
| 3,599,594 | A | 8/1971 | Taipale | |
| 4,371,349 | A * | 2/1983 | Edwards | 440/56 |
| 4,482,330 | A | 11/1984 | Cook | |
| 4,726,797 | A * | 2/1988 | Taguchi | 440/63 |
| 4,826,460 | A | 5/1989 | Zuckerman | |
| 4,964,354 | A | 10/1990 | Latham | |
| 5,186,666 | A | 2/1993 | Stanley | |
| 5,647,781 | A | 7/1997 | Johnson | |
| 6,354,893 | B1 | 3/2002 | Sato | |
| 6,419,534 | B1 | 7/2002 | Helsel et al. | |
| 6,659,817 | B1 | 12/2003 | Anderson et al. | |
| 6,669,517 | B1 | 12/2003 | Alby et al. | |
| 6,830,492 | B1 | 12/2004 | Magee et al. | |
| 7,198,530 | B1 | 4/2007 | Rothe et al. | |
| 7,244,152 | B1 | 7/2007 | Uppgard | |

* cited by examiner

*Primary Examiner* — Stephen Avila
(74) *Attorney, Agent, or Firm* — William D. Lanyi

(57) ABSTRACT

A support system for an outboard motor provides a restricted member that is attached to a bottom portion of the outboard motor and a restricting member that is attached to a support structure that is, in turn, attached to a transom of a marine vessel. The restricted member is prevented from moving in a starboard or port direction by a magnitude greater than a preselected magnitude that is defined by a gap between restricting and restricted surfaces that move into contact with each other when forces on the outboard motor cause a lower portion of the outboard motor to move by a magnitude greater than a predefined limit in either the port or starboard directions. Preselected gaps between restricting and restricted surfaces are sized to allow nominal vibration at low operating speeds of the outboard motor while restricting excessive lateral movement during operation at high speed.

15 Claims, 7 Drawing Sheets

OUTBOARD MOTOR SUPPORT SYSTEM

BACKGROUND OF THE INVENTION

1. Field of the Invention

The present invention is generally related to a support system for an outboard motor and, more particularly, to a system that restricts the maximum movement, toward port or starboard, of a preselected portion of the outboard motor.

2. Description of the Related Art

Those skilled in the art of outboard motors are familiar with many different types of mounting systems for outboard motors. Typically, resilient mounts incorporate an elastomeric portion that isolates vibration from being transmitted to a marine vessel from the outboard motor. In addition, those skilled in the art are familiar with many different types of mounting bracket systems that attach an outboard motor to a transom of a marine vessel.

U.S. Pat. No. 3,599,594, which issued to Taipale on Aug. 17, 1971, discloses a sound and vibration isolating mount for an outboard motor. It includes a pair of mounts secured to the propulsion unit in a vertically spaced relation approximately in alignment with the neutral or roll axis of the propulsion unit and rearwardly of or behind the driveshaft. Each mount includes a crossbar which is supported by a resilient bushing within a casing and which has ends extending outwardly from the casing transversely to the direction of motion of the propulsion unit.

U.S. Pat. No. 4,482,330, which issued to Cook on Nov. 13, 1984, describes an outboard motor mounting apparatus. It comprises two slidably connected brackets, one for securing to the transom of the boat and one for carrying the outboard motor. It also has a hydraulic actuating cylinder connected between the two brackets for moving the motor mounting bracket along a vertical line relative to the bracket secured to the transom.

U.S. Pat. No. 4,826,460, which issued to Zuckerman on May 2, 1989, describes an outboard marine engine stabilizing device. It includes a plate having two spaced apart arms which are adapted to be connected to opposite sides of the powerhead of the motor and adapted to be connected to the steering arm of the motor at the end of the plate generally opposite to the location of the connection of the arms to the motor.

U.S. Pat. No. 4,964,354, which issued to Latham on Oct. 23, 1990, describes a steering plate for an outboard motor. It attaches to an outboard motor without disturbing the joint between engine mounting and driveshaft housing. The attachment fastens to the motor at the sides and rear in two parallel horizontal planes and a vertical plane for rigidity to resist forces in diverse directions.

U.S. Pat. No. 5,186,666, which issued to Stanley on Feb. 16, 1993, describes a marine motor drive unit mounting apparatus. It comprises first and second boat mounting members securable to a boat and lying in a boat plane and includes first and second motor mounting members securable to a motor and lying in a motor plane spaced apart from the boat plane by a distance. The motor plane has an angular orientation relative to the boat plane. The device for setting the motor mounting members in a position displaced from the boat mounting members is connected between the boat mounting members and the motor mounting members.

U.S. Pat. No. 5,647,781, which issued to Johnson on Jul. 15, 1997, describes an outboard motor support. It is intended to prevent damage from inadvertent pivoting of the motor during trailering. The support is attached to the motor and boat without making modifications thereto and handles are affixed to the spring loaded locking pins for easy manipulation.

U.S. Pat. No. 6,354,893, which issued to Sato on Mar. 12, 2002, describes a mounting structure for an outboard motor. In an outboard motor equipped with an engine mounted on an engine holder that is attached to a hull by a mounting device, and equipped with a crankshaft disposed more or less vertically within the engine and from which rotational force is transmitted to a propelling device by a driveshaft, the axis of the driveshaft is disposed in a position offset away from the axis of the crankshaft a little to the rear of the outboard motor, a pair of left and right mount holders are formed adjacent to the center of gravity of the outboard motor within the engine holder, the mount units are inserted into these mount holders from the front side of the engine holder, the driveshaft is inserted between the mount holders, and the mount holders are formed as close as possible to a protective wall for the driveshaft so that the mount holders can clear the protective wall.

U.S. Pat. No. 6,419,534, which issued to Helsel et al. on Jul. 16, 2002, discloses a structural support system for an outboard motor. The system is provided for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within 45 degrees of perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

U.S. Pat. No. 6,659,817, which issued to Anderson et al. on Dec. 9, 2003, discloses an alignment system for an outboard motor. First and second pliable members are each attached to an outboard motor and to a fixed location on the transom or transom bracket associated with the outboard motor. One pliable member is used on the starboard side of the outboard motor while another is used on the port side. As the outboard motor is tilted about its trim axis, the two pliable members work in coordination with each other to exert a force on the outboard motor in a direction away from any direction in which the outboard motor is rotated about its steering axis as it is being tilted about its trim axis.

U.S. Pat. No. 6,669,517, which issued to Alby et al. on Dec. 30, 2003, discloses a multiple part cowl structure for an outboard motor. The structure comprises first and second cowl members that are independent components. A first cowl member is attachable, by a latch mechanism, to a support structure of the outboard motor. The second cowl member is attachable by a latch mechanism, to both the first cowl member and the support structure.

U.S. Pat. No. 6,830,492, which issued to Magee et al. on Dec. 14, 2004, discloses a marine drive trim cylinder with a two stage damping system. The mounting bushings comprise inner and outer tubes with an elastomeric material disposed between the inner and outer tubes. The elastomeric material is structured to provide a soft rate of stiffness in response to relatively light loads, such as shifting loads, and a harder rate of stiffness in response to higher loads, such as during high thrust loads or wide open throttle operation of a marine vessel.

U.S. Pat. No. 7,198,530, which issued to Rothe et al. on Apr. 3, 2007, discloses a resilient mount system for an outboard motor. The support structure for an outboard motor provides a connection bar between an engine support structure and a steering structure. A tubular outer member is spaced apart from the attachment bar and connected to the attachment bar with an elastomeric member. Vibration isolation and consistency of deformation is achieved through the interaction of the individual elements of the structure.

U.S. Pat. No. 7,244,152, which issued to Uppgard on Jul. 17, 2007, discloses a support system for an outboard motor. An adapter system is provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having a stationary vertical steering axis and pedestal-type configuration.

The patents described above are hereby expressly incorporated by reference in the description of the present invention.

Certain types of outboard motors place all of the resilient mounts above a preselected vertical position. Outboard motors of this type are described in U.S. Pat. Nos. 6,419,534 and 6,669,517. Because of this structure, the lower portion of the outboard motor is not directly connected to any stationary portion of the mount system. When the lower portion of the outboard motor is subjected to significant loads in either the port or starboard directions, the outboard motor can assume a position that varies significantly from a generally vertical axis. If this occurs, undesirable steering reactive forces can be felt by the operator of the marine vessel and control of the marine vessel can be adversely affected. Since outboard motors of this type exhibit many highly desirable characteristics such as reduced vibration and quiet operation, it would not be desirable to increase the stiffness of the support system or provide additional attachment between the lower portion of the outboard motor and the support brackets which are attached to the marine vessel. It would therefore be significantly beneficial if an outboard motor could be provided with a relatively soft support system when it is operated at low speeds, but with a strong resistance to deflection of the outboard motor from a generally vertical axis when it is operated at higher speeds and loads. It would also be beneficial if the outboard motor of this general type could continue to be supported only at a location above the vertical center of the outboard motor while also being provided with a way to physically restrict the port and starboard movement of the lower portion of the outboard motor when it is operated at higher speeds and loads.

SUMMARY OF THE INVENTION

An outboard motor support system made in accordance with a preferred embodiment of the present invention comprises a restricting member which is attachable to a marine vessel and a restricted member which is attachable to a preselected portion of the outboard motor. The restricting member is configured to prevent the restricted member from moving in a starboard direction relative to the restricting member by greater than a first preselected magnitude and the restricting member is configured to prevent the restricted member from moving in a port direction relative to the restricting member by greater than a second preselected magnitude.

The restricted member is positioned to move into contact with a restricting member in response to movement of more than the first preselected magnitude in the starboard direction by the restricted member and the restricted member is positioned to move into contact with a restricting member in response to movement of more than the second preselected magnitude in the port direction by the restricted member.

The restricting member comprises first and second restricting surfaces and the restricted member comprises first and second restricted surfaces. The first and second restricting surfaces are disposed at least partially between the first and second restricted surfaces in a preferred embodiment of the present invention. When used in conjunction with a marine vessel, a preferred embodiment of the present invention further comprises an outboard motor which, in turn, comprises a support bracket which is shaped to be attached to a transom of a marine vessel. The first and second restricting surfaces are shaped to remain disposed at least partially between the first and second restricting surfaces when the outboard motor is rotated about its trim axis within the operating range of the outboard motor. In certain embodiments of the present invention, the first and second restricted surfaces are disposed on first and second plates, respectively, of the restricted member and the first and second restricting surfaces are disposed on first and second pads, respectively, of the restricting member.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
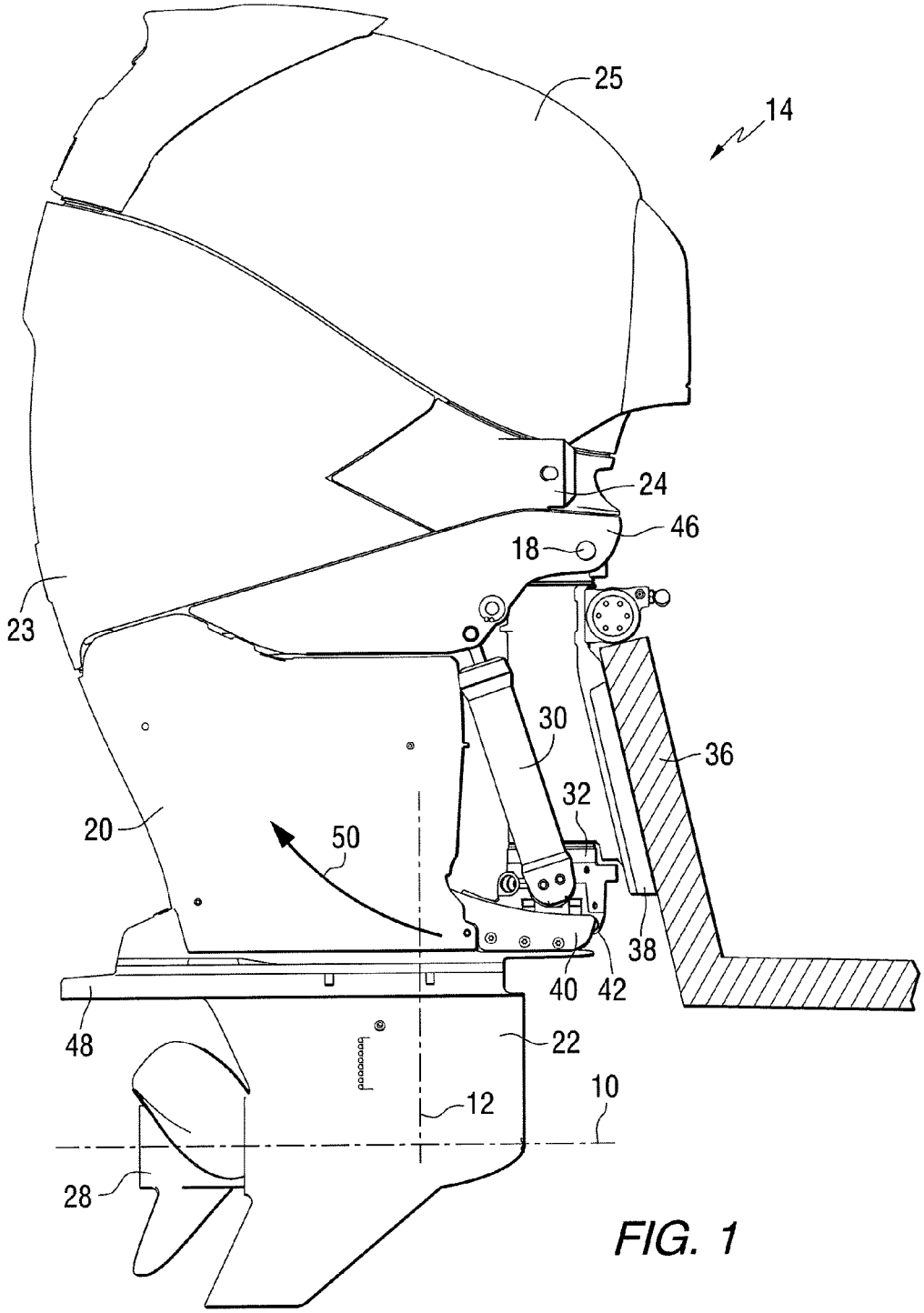
FIGS. 1 and 2 show an outboard motor at two different trim positions.

Throughout the description of the preferred embodiment of the present invention, like components will be identified by like reference numerals.

Figure 2:
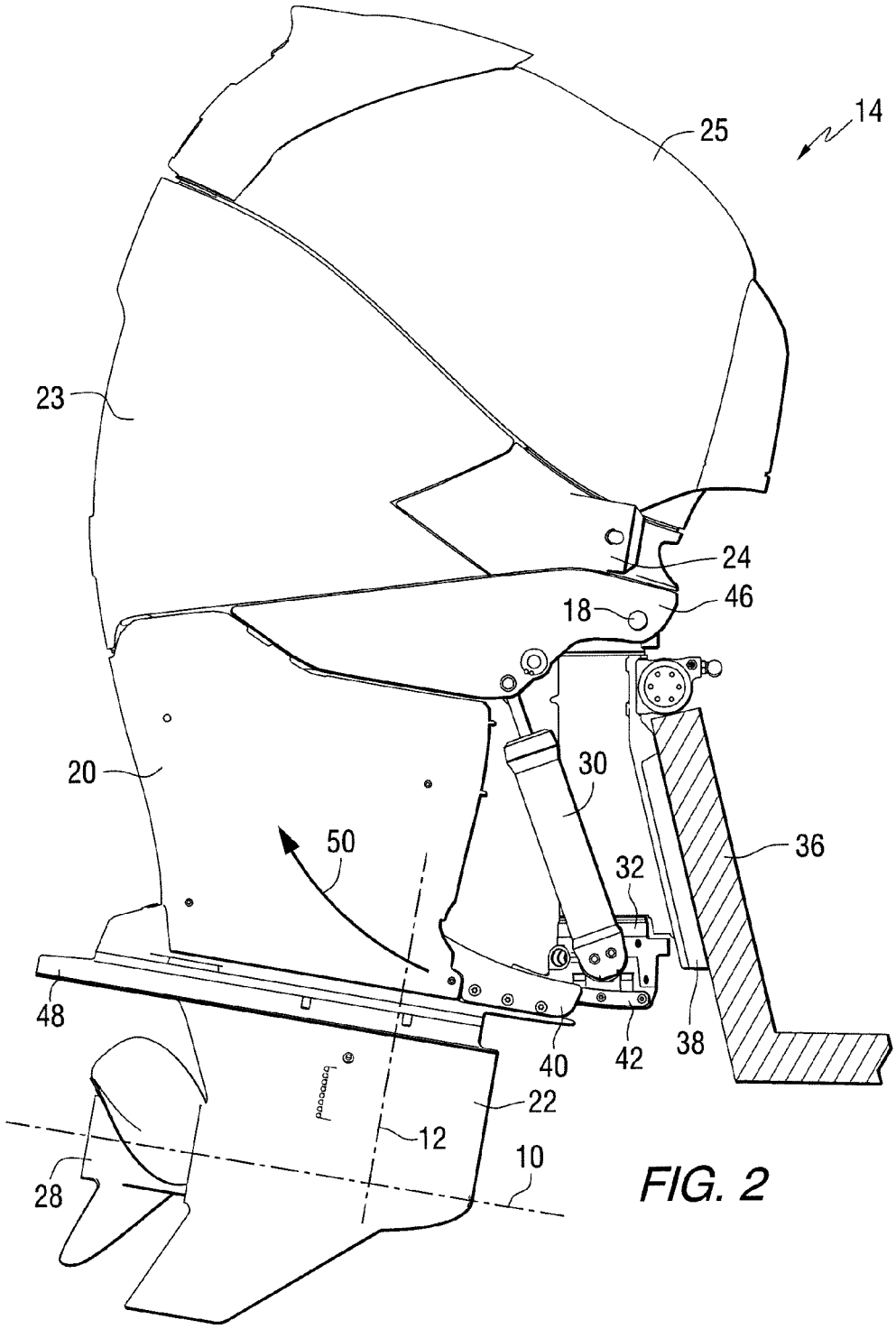

FIG. 1 is a side view, viewed from the starboard side of a marine vessel, of a marine propulsion device made in accordance with a preferred embodiment of the present invention. A line 10 is provided to represent the location of a propeller shaft axis with respect to another line 12 which represents a driveshaft axis of the outboard motor 14. It can be seen that the driveshaft axis 12 in FIG. 1 is generally vertical as a result of the trim position of the outboard motor 14. In comparison, the driveshaft axis 12 illustrated in FIG. 2 represents an angular rotation of the outboard motor about its trim axis 18. These two trim positions of the outboard motor 14, shown in FIGS. 1 and 2, are provided to illustrate certain features and characteristics of the outboard motor support system which will be described in greater detail below.

With continued reference to FIGS. 1 and 2, the outboard motor 14 has a driveshaft housing 20, a gear case 22, and several cowl sections, 23-25. A propeller 28 is supported for rotation about the propeller shaft axis 10. A trim cylinder 30 and a valve manifold 32 are provided to hydraulically exert the required force necessary to rotate the outboard motor 14 about its trim axis 18. For purposes of reference, a transom 36 is shown. A support bracket 38 of the outboard motor 14 is attached to the transom 36. As will be described in greater detail below, a restricted member 40 and a restricting member 42 are provided, in a preferred embodiment of the present invention, to limit the magnitude of displacement of a lower portion of the outboard motor relative to both the upper portion of the outboard motor 14 and the transom bracket 38.

Figure 3:
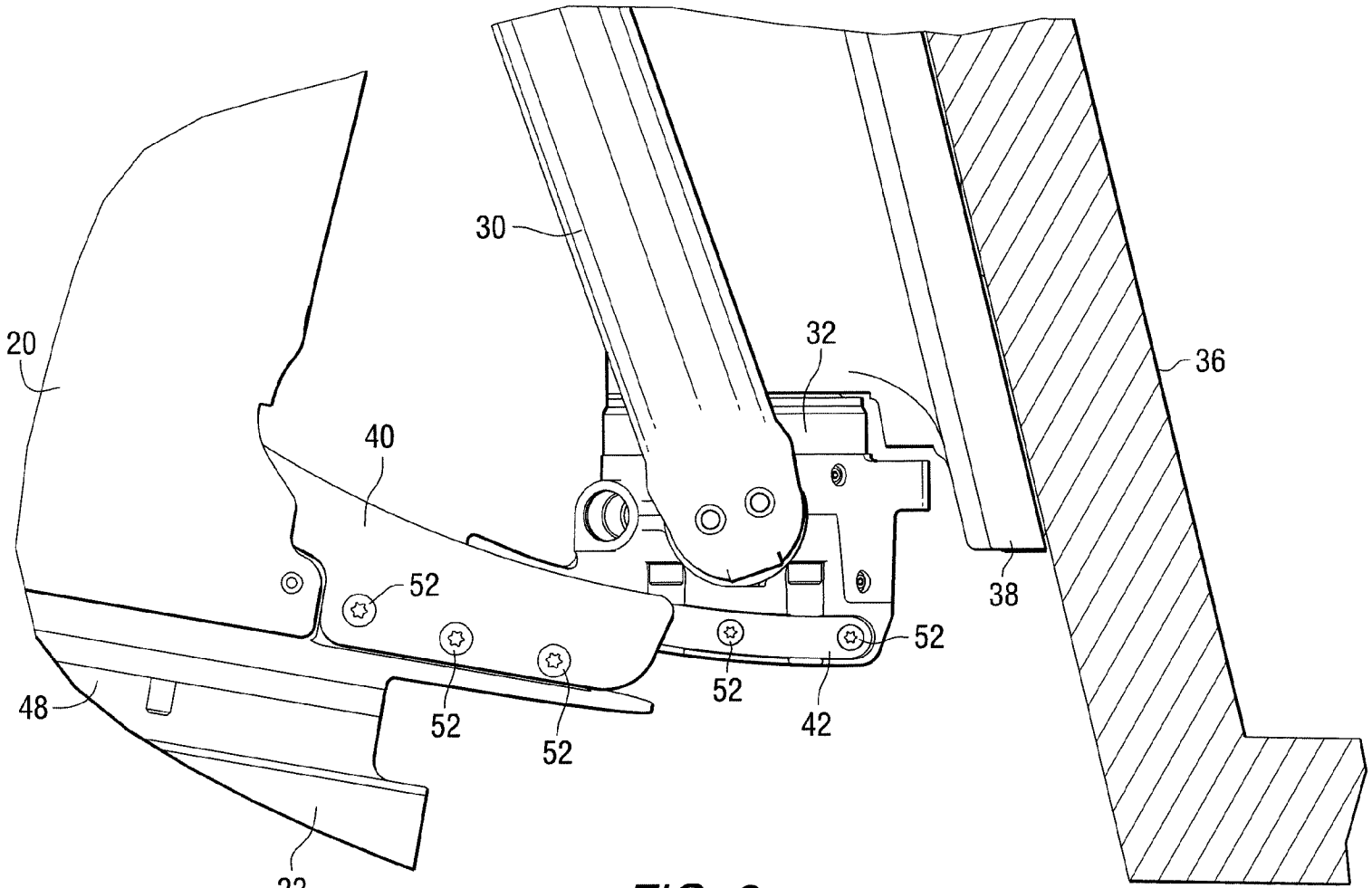
FIG. 3 is an enlarged portion of the illustration shown in FIG. 2.

The preferred embodiment of the present invention will be described below in conjunction with an outboard motor 14 that is of the general type which is described in U.S. Pat. Nos. 6,419,534 and 6,669,517. As described in those two patents, and most particularly in U.S. Pat. No. 6,419,534, the support mounts of the outboard motor 14 are located proximate the center of gravity of the outboard motor 14 and above a generally central vertical location of the outboard motor. This particular characteristic is illustrated in FIG. 3 of the U.S. Pat. No. 6,419,534 and also described in detail in conjunction with FIGS. 9 and 10 of that patent. This characteristic, which places the support mounts at a location within the support structure identified by reference numeral 46 in FIGS. 1 and 2 can possibly allow the lower portion of the outboard motor 14, such as the gear case 22, to move or deflect in a port or starboard direction relative to the upper portion of the outboard motor, at or above the support structure 46. One advantageous purpose of the present invention is to limit the magnitude of any deflection, in a port or starboard direction, of the lower portion of the outboard motor 14, with respect to the upper portion of the outboard motor in the region of the support structure 46.

With continued reference to FIGS. 1 and 2, the restricted member 40 of the present invention is attachable to a preselected portion (e.g. above and proximate to the antiventilation plate 48) and the restricting member 42 is attachable to the marine vessel as a result of its being attachable to the hydraulic valve manifold structure 32 which, in turn, is attachable to the bracket 38. The bracket 38 is attachable to a transom 36 of a marine vessel. Therefore, with respect to the marine vessel, the restricting member 42 is stationary and the restricted member 40 is movable in coordination with the outboard motor 14. This movement can occur in a port and starboard direction when the gear case 22 moves in response to thrusts encountered during operation of the outboard motor at high speeds and also in response to rotation of the outboard motor 14 about its trim axis 18 which causes the restricted member 40 to move along an arcuate path 50.

FIG. 3 is an enlarged portion of the illustration of FIG. 2, showing the valve manifold 32 to which the restricting member 42 is attached. The restricting member 42 is removably attachable to the support bracket 38 which is, in turn, removably attachable to the transom 36. Similarly, the restricted member 40 is removably attachable to the outboard motor. A plurality of screws 52 are provided for this purpose.

Figure 4:
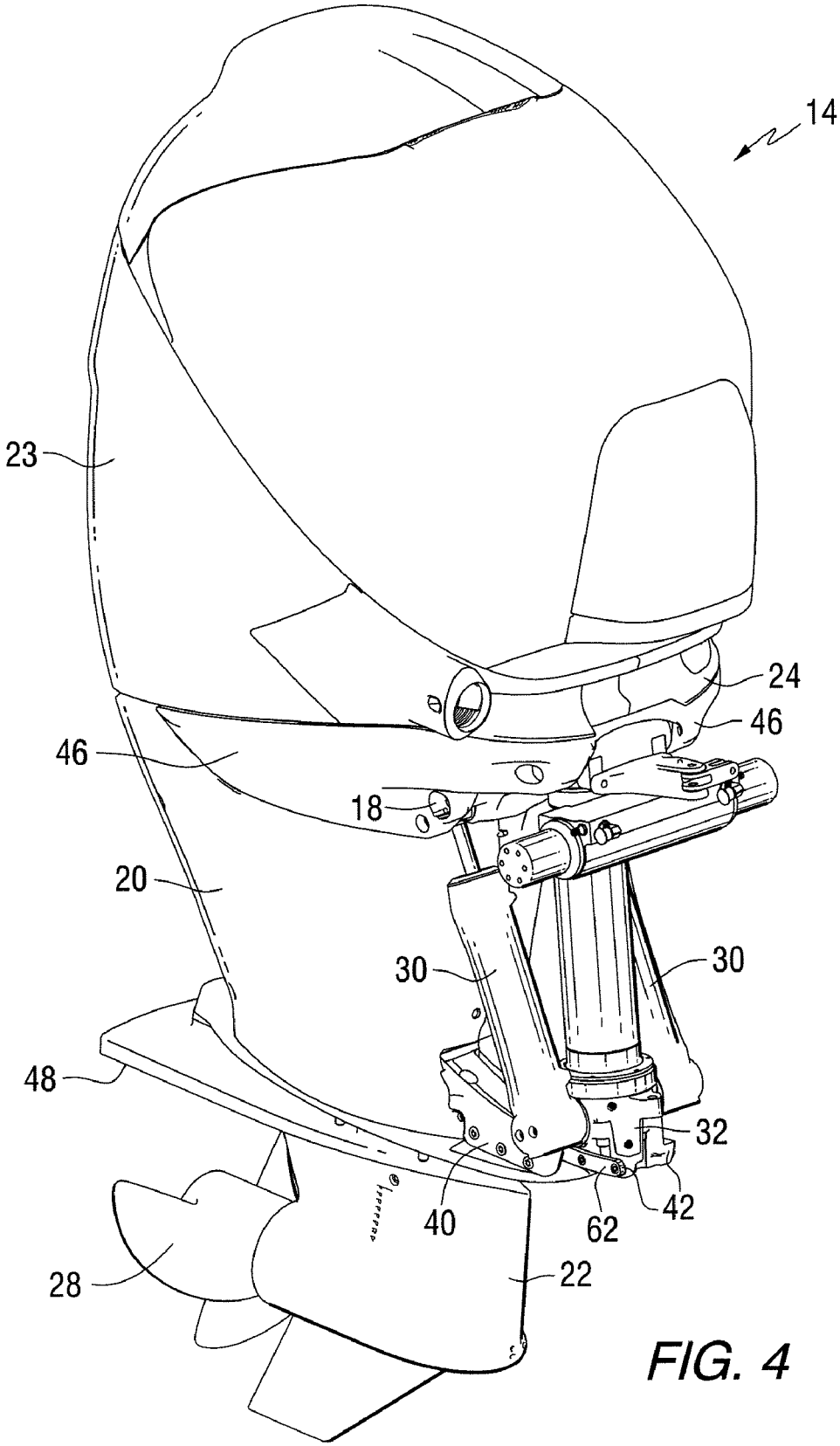
FIG. 4 is an isometric view of the outboard motor shown in FIG. 2.
Figure 5:
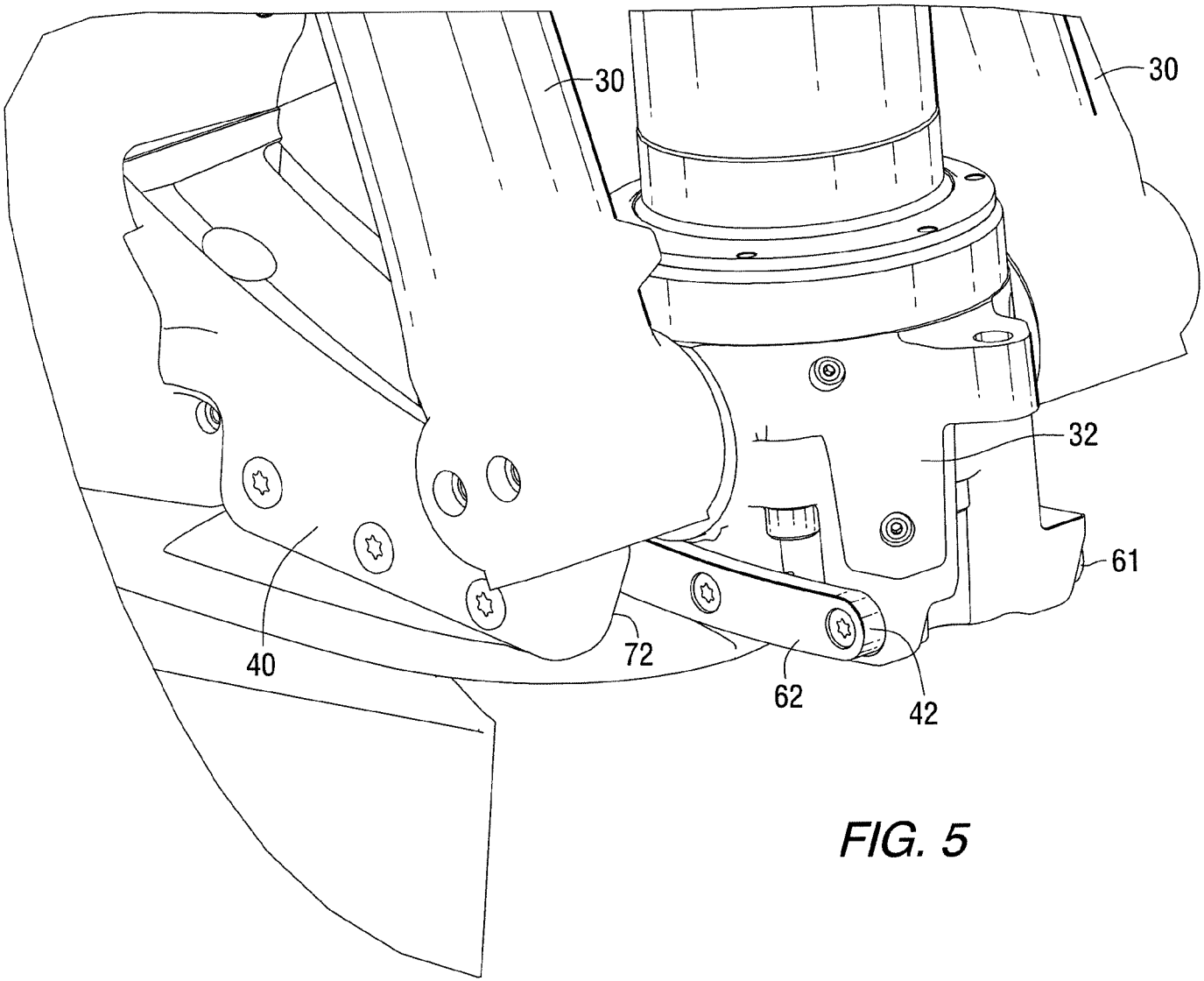
FIG. 5 is an enlarged view of a portion of the outboard motor shown in FIG. 4.

FIG. 4 is an isometric view of the outboard motor 14 which was described above in conjunction with FIGS. 1-3. FIG. 5 is an enlarged view of a portion of the outboard motor, showing a preferred embodiment of the present invention.

With continued reference to FIGS. 4 and 5, the restricting member 42 comprises first and second restricting surfaces, 61 and 62. The restricted member 40 comprises first and second restricted surfaces, 71 and 72. The first restricted surface 71 is not shown in FIG. 5, but will be described in greater detail below in conjunction with FIGS. 6-9. The second restricted surface 72 is on the surface of the restricted member 40 which faces the second restricting surface 62. The relationship between the first and second restricting surfaces, 61 and 62, and the first and second restricted surfaces 71 and 72, will be described in conjunction with FIGS. 6-9.

FIGS. 6-9 are highly simplified schematic representations which show the relationships between the restricted and restricting members under various operating conditions. In FIGS. 6-9, the restricting member 42 is illustrated as a dashed line box that represents a stationary structure, such as the valve manifold 32, to which a first pad 81 and a second pad 82 are removably attached. The first restricting surface 61 is a surface of the first pad 81 and the second restricting surface 62 is a surface of the second pad 82. The restricted member 40 (e.g. a lower portion of an outboard motor) is represented by a dashed line box in FIGS. 6-9. The restricted member comprises a first plate 91 and a second plate 92 that are attached to a lower portion of the outboard motor as described above in conjunction with FIGS. 1-5. The first restricted surface 71 is a surface of the first plate 91 and the second restricted surface 72 is a surface of the second plate 92. In FIGS. 6-9, a reference dashed line 100 is provided to identify a reference stationary position in the arrangement of restricted and restricting elements and surfaces.

Figure 6:
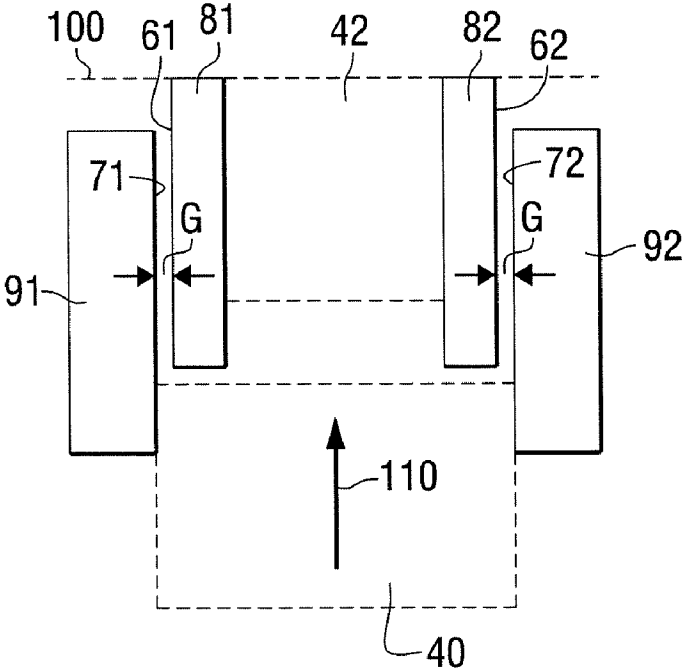

FIG. 6 shows the restricted member 40 moved in a forward direction, as represented by arrow 110, to a position generally similar to that shown in FIG. 1. The first restricted and restricting surfaces, 71 and 61, respectively, are also facing each other with a gap G therebetween. The second restricted and restricting surfaces, 72 and 62, respectively, are facing each other with a gap G therebetween. It should be understood that, although identically sized gaps G are used in the description of FIGS. 6-9, this equality is not required in all embodiments of the present invention. However, if the outboard motor is generally centered with respect to the transom bracket 38 and the valve manifold 32, the gaps G will be generally equal to each other. In a particularly preferred embodiment of the present invention, it has been determined that a gap G which is generally equal to 0.10 inches is satisfactory to achieve the goals of restricting the side-to-side movement of the outboard motor during high speed operation while also maintaining quiet operation when the engine of the outboard motor is operated at idle speed.

Figure 7:
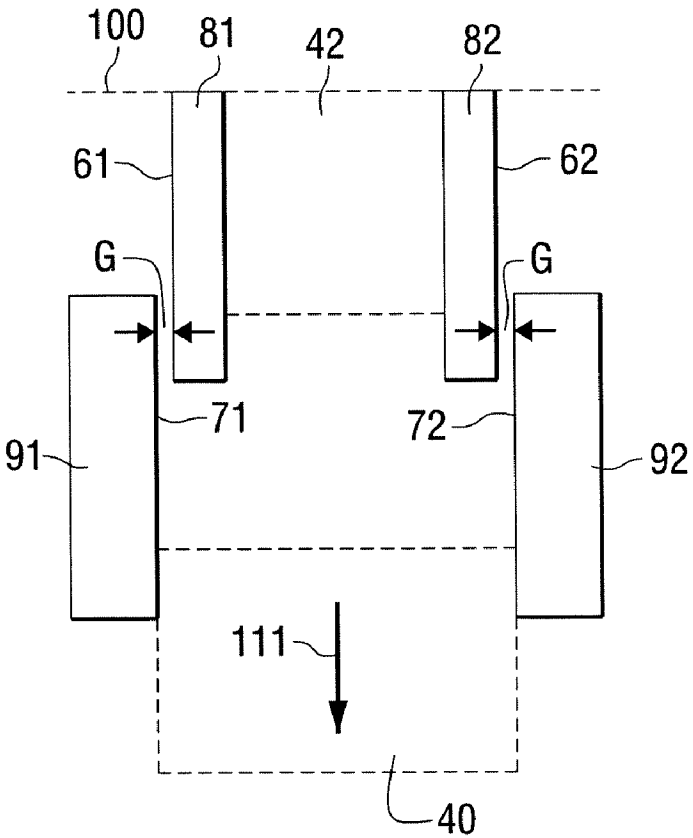
FIGS. 6 and 7 are highly schematic representations of two trim positions with respect to the restricted and restricting members of a preferred embodiment of the present invention.

FIG. 7 is similar to FIG. 6, but with the outboard motor trimmed to a position similar to that described above in conjunction with FIG. 2. That moves the restricted member 40 in a direction represented by arrow 111 which reduces the overlap between the first and second restricted surfaces, 71 and 72, with the first and second restricting surfaces, 61 and 62, respectively. However, it can be seen that the magnitude of the gap G remains generally equal to that illustrated in FIG. 6 when the outboard motor is trimmed in a forward direction.

With continued reference to FIGS. 6 and 7, it should be noted that dashed line 100 is stationary regardless of the trim position of the outboard motor. In addition, the restricting member 42 remains stationary with respect to the transom of the marine vessel even though the restricted member 40 moves relative to the transom.

Figure 8:
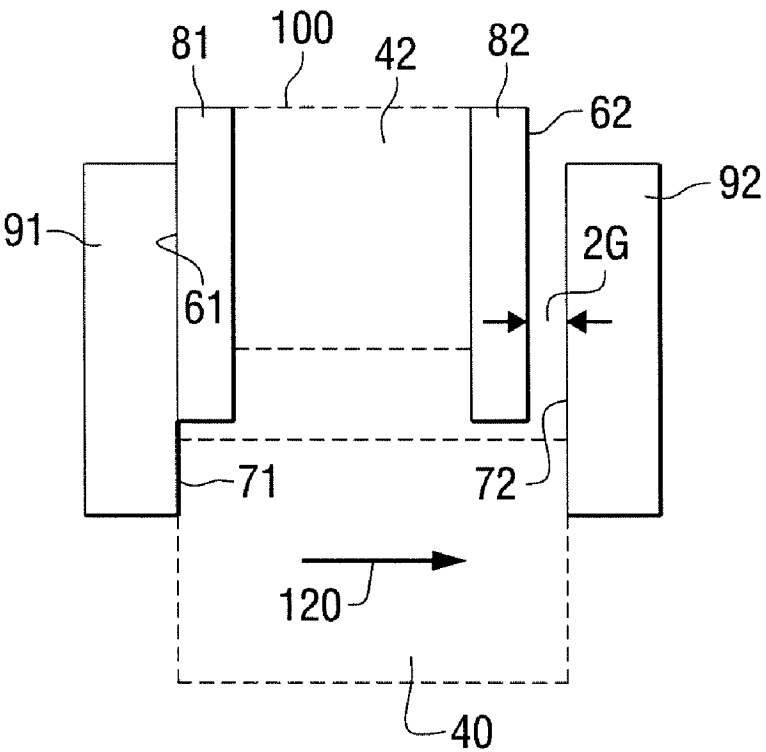

FIG. 8 illustrates the condition when the restricted member 40 moves in a starboard direction as represented by arrow 120. This causes the first restricted surface 71 to move into contact with first restricting surface 61. This contact prevents further movement of the lower portion of the outboard motor in a starboard direction. As a result, the gap between the first plate 91 and the first pad 81 is reduced to zero and the gap between the second plate 92 and the second pad 62 is essentially doubled. The condition shown in FIG. 8 would occur during high speed maneuvers that result in significant forces being exerted in a starboard direction against the lower portion of the outboard motor. The contact between the first restricting surface 61 and the first restricted surface 71 minimizes the movement of the lower portion of the outboard motor and improves the overall control available to the operator of the marine vessel during high speed maneuvers.

Figure 9:
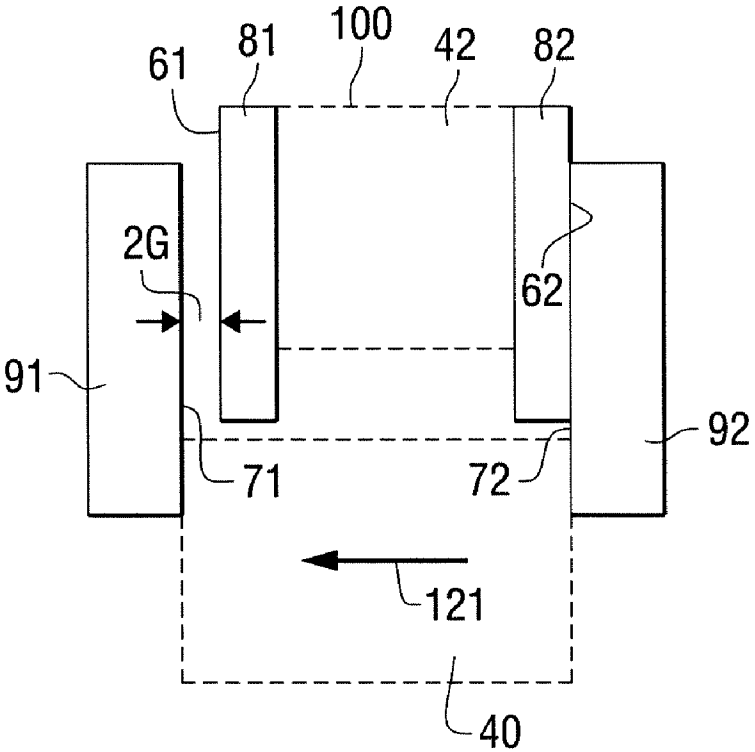
FIGS. 8 and 9 are generally similar to FIGS. 6 and 7, but with respect to relative movement between the restricted and restricting members in port and starboard directions.

FIG. 9 illustrates a condition that is generally opposite to that shown in FIG. 8. Arrow 121 indicates that the lower portion of the outboard motor has moved in a port direction relative to the marine vessel. This causes the second plate 92 of the restricted member 40 to move into contact with the second pad 82 of the restricting member 42. When the second restricted surface 72 moves into contact with the second restricting surface 62, movement of the lower portion of the outboard motor in a port direction is inhibited. This essentially eliminates the gap between the second restricted and restricting surfaces, 72 and 62, and doubles the gap between the first restricted and restricting surfaces, 71 and 61, respectively.

With continued reference to FIGS. 6-9, it has been empirically determined that a gap G generally equal to approximately 0.10 inches is sufficient to avoid contact between the restricted and restricting members, 40 and 42, respectively, during operation of the engine at idle speed. Although operation of the engine at low speed can cause slight movement of the outboard motor and, as a result, of the restricted member 40, that movement is not sufficient under most conditions to cause contact between the restricting and restricted members, 42 and 40. In addition, it has been empirically determined that this relative spacing between the restricted and restricting members is adequate to limit the port or starboard movement of the lower portion of the outboard motor during high speed operation to significantly enhance the control provided to the operator of the marine vessel.

With continued reference to FIGS. 1-9, it can be seen that an outboard motor support system made in accordance with a preferred embodiment of the present invention comprises an outboard motor 14 which, in turn, comprises a support bracket 38 which is shaped to be attached to a transom 36 of a marine vessel, a restricting member 42 which is attachable to the marine vessel, a restricted member 40 which is attachable to a preselected portion of the outboard motor 14 wherein the restricting member 42 is configured to prevent the restricted member 40 from moving in a starboard direction relative to the restricting member 42 by greater than a first preselected magnitude G and the restricting member 42 is configured to prevent the restricted member 40 from moving in a port direction relative to the restricting member by greater than a second preselected magnitude (equal to G in the illustrated embodiment). The restricted member 40 is positioned to move into contact with the restricting member 42 in response to movement of more than the first preselected magnitude G in the starboard or port directions. As described above, although the illustrated embodiment centers the restricted member 40 relative to the restricting member 42, and results in equal gaps G, this is not a required characteristic in all embodiments of the present invention.

The restricting member 42 comprises first and second restricting surfaces, 61 and 62. The restricted member 40 comprises first and second restricted surfaces, 71 and 72. The first restricted surface 71 is positioned to move into contact with the first restricting surface 61 in response to movement of more than the first preselected magnitude G in the starboard direction by the restricted member 40. The second restricted surface 72 is positioned to move into contact with the second restricting surface 62 in response to movement of more than the second preselected magnitude G in the port direction by the restricted member 40. The first and second restricting surfaces, 61 and 62, are disposed at least partially between the first and second restricted surfaces, 71 and 72. A preferred embodiment of the present invention further comprises an outboard motor 14 comprising a support bracket 38 which is shaped to be attached to the transom 36 of a marine vessel. The first and second restricting surfaces, 61 and 62, are shaped to remain disposed at least partially between the first and second restricted surfaces, 71 and 72, when the outboard motor 14 is rotated about its trim axis 18 within the operating range of the outboard motor 14. In a preferred embodiment of the present invention, the first restricted surface 71 is disposed on a first plate 91 of the restricted member 40, the second restricted surface 72 is disposed on a second plate 92 of the restricted member 40, the first restricting surface 61 is disposed on a first pad 81 of the restricting member 42, and the second restricting surface 62 is disposed on a second pad 82 of the restricting member 42.

With continued reference to FIGS. 1-9, in a preferred embodiment of the present invention, the restricting member 42 is removably attachable to the support bracket 38 and the restricted member 40 is removably attachable to the outboard motor 14. The preselected portion of the outboard motor is above an antiventilation plate 48 of the outboard motor and is lower than the support bracket 38 in a preferred embodiment. The restricted member 40 is movable along an arcuate path 50 in response to the outboard motor 14 being rotated about its trim axis 18.

Although the present invention has been described in particular detail and illustrated to show a preferred embodiment, it should be understood that alternative embodiments are also within its scope.

We claim:

1. An outboard motor support system, comprising:

a restricting member which is attachable to a marine vessel; and a restricted member which is attachable to a preselected portion of said outboard motor, said restricting member being configured to prevent said restricted member from moving in a starboard direction relative to said restricting member by greater than a first preselected magnitude, said restricting member being configured to prevent said restricted member from moving in a port direction relative to said restricting member by greater than a second preselected magnitude;

wherein said first restricted surface is disposed on a first plate of said restricted member, said second restricted surface is disposed on a second plate of said restricted member, said first restricting surface is disposed on a first pad of said restricting member, and said second restricting surface is disposed on a second pad of said restricting member.

2. The support system of claim 1, wherein:

said restricted member is positioned to move into contact with said restricting member in response to movement of more than said first preselected magnitude in said starboard direction by said restricted member; and said restricted member is positioned to move into contact with said restricting member in response to movement of more than said second preselected magnitude in said port direction by said restricted member.

3. The support system of claim 1, wherein:

said restricting member comprises first and second restricting surfaces; and said restricted member comprises first and second restricted surfaces, said first restricted surface being positioned to move into contact with said first restricting surface in response to movement of more than said first preselected magnitude in said starboard direction by said restricted member, said second restricted surface being positioned to move into contact with said second restricting surface in response to movement of more than said second preselected magnitude in said port direction by said restricted member.

4. The support system of claim 1, wherein:

said first and second restricting surfaces are disposed at least partially between said first and second restricted surfaces.

5. The support system of claim 4, further comprising:

an outboard motor comprising a support bracket which is shaped to be attached to a transom of said marine vessel.

6. The support system of claim 5, wherein:

said first and second restricting surfaces are shaped to remain disposed at least partially between said first and second restricted surfaces when said outboard motor is rotated about its trim axis within the operating range of said outboard motor.

7. The support system of claim 1, wherein:

said first restricting surface is spaced apart from said first restricted surface by a first gap which is sized to prevent contact between said first restricting surface and said first restricted surface when said outboard motor is operated at a speed below a preselected threshold; and said second restricting surface is spaced apart from said second restricted surface by a second gap which is sized to prevent contact between said second restricting surface and said second restricted surface when said outboard motor is operated at a speed below said preselected threshold.

8. An outboard motor support system, comprising:

an outboard motor comprising a support bracket which is shaped to be attached to a transom of a marine vessel;

a restricting member which is attachable to said marine vessel;

a restricted member which is attachable to a preselected portion of said outboard motor, said restricting member being configured to prevent said restricted member from moving in a starboard direction relative to said restricting member by greater than a second preselected magnitude, said restricting member being configured to prevent said restricted member from moving in a port direction relative to said restricting member by greater than a second preselected magnitude, said second and second restricting surfaces being disposed at least partially between said second and second restricted surfaces;

wherein said second and second restricting surfaces are shaped to remain disposed at least partially between said second and second restricted surfaces when said outboard motor is rotated about its trim axis within the operating range of said outboard motor; and wherein said second restricted surface is disposed on a second plate of said restricted member; said second restricted surface is disposed on a second plate of said restricted member; said second restricting surface is disposed on a second pad of said restricting member; and said second restricting surface is disposed on a second pad of said restricting member.

9. The support system of claim 8, wherein:

said restricted member is positioned to move into contact with said restricting member in response to movement of more than said second preselected magnitude in said starboard direction by said restricted member; and said restricted member is positioned to move into contact with said restricting member in response to movement of more than said second preselected magnitude in said port direction by said restricted member.

10. The support system of claim 9, wherein:

said restricting member comprises second and second restricting surfaces; and said restricted member comprises second and second restricted surfaces, said second restricted surface being positioned to move into contact with said second restricting surface in response to movement of more than said second preselected magnitude in said starboard direction by said restricted member, said second restricted surface being positioned to move into contact with said second restricting surface in response to movement of more than said second preselected magnitude in said port direction by said restricted member.

11. An outboard motor support system, comprising:

an outboard motor comprising a support bracket which is shaped to be attached to a transom of a marine vessel;

a restricting member which is attachable to said marine vessel; and a restricted member which is attachable to a preselected portion of said outboard motor, said restricting member being configured to prevent said restricted member from moving in a starboard direction relative to said restricting member by greater than a second preselected magnitude, said restricting member being configured to prevent said restricted member from moving in a port direction relative to said restricting member by greater than a second preselected magnitude, said restricted member being positioned to move into contact with said restricting member in response to movement of more than said second preselected magnitude in said starboard direction by said restricted member, said restricted member being positioned to move into contact with said restricting member in response to movement of more than said second preselected magnitude in said port direction by said restricted member, said restricting member comprising second and second restricting surfaces, said restricted member comprising second and second restricted surfaces, said second restricted surface being positioned to move into contact with said second restricting surface in response to movement of more than said second preselected magnitude in said starboard direction by said restricted member, said second restricted surface being positioned to move into contact with said second restricting surface in response to movement of more than said second preselected magnitude in said port direction by said restricted member, said second and second restricting surfaces being disposed at least partially between said second and second restricted surfaces, said second and second restricting surfaces being shaped to remain disposed at least partially between said second and second restricted surfaces when said outboard motor is rotated about its trim axis within the operating range of said outboard motor, said second restricted surface being disposed on a second plate of said restricted member, said second restricted surface being disposed on a second plate of said restricted member, said second restricting surface being disposed on a second pad of said restricting member, said second restricting surface being disposed on a second pad of said restricting member.

12. The support system of claim 11, wherein:

said restricting member is removably attachable to said support bracket and said restricted member is removably attachable to said outboard motor.

13. The support system of claim 12, wherein:

said preselected portion of said outboard motor is above an anti-ventilation plate of said outboard motor.

14. The support system of claim 13, wherein:

said preselected portion of said outboard motor is lower than said support bracket.

15. The support system of claim 14, wherein:

said restricted member is movable along an arcuate path in response to said outboard motor being rotated about said trim axis.

* * * * *